US005364240A

United States Patent [19]

Salecker

[11] Patent Number: 5,364,240

[45] Date of Patent: Nov. 15, 1994

[54] FLUID PUMP WITH PULSING FEATURE

[75] Inventor: Roy W. Salecker, Mendota, Ill.

[73] Assignee: Spartan Tool Div. of Pettibone Corp., Mendota, Ill.

[21] Appl. No.: 137,288

[22] Filed: Oct. 14, 1993

[51] Int. Cl.[5] ..... F04B 23/00

[52] U.S. Cl. ..... 417/427; 251/82

[58] Field of Search ..... 417/254, 251, 252, 256, 417/258, 265, 266, 446, 426, 427, ; 257/82

[56] References Cited

U.S. PATENT DOCUMENTS

| | | | |
|---|---|---|---|
| 1,176,518 | 3/1916 | Burns | 134/167 R |
| 1,218,567 | 3/1917 | Pottenger, Jr. | 137/624.14 |
| 1,789,376 | 1/1931 | White | 417/446 |
| 2,069,340 | 2/1937 | White | 137/624.14 |
| 2,580,433 | 1/1952 | Kain | 137/624.14 |
| 2,620,825 | 12/1952 | Cannon | 137/624.14 |
| 3,216,328 | 11/1965 | Peterson | 91/52 |
| 3,230,839 | 1/1966 | Gaston | 91/50 |
| 3,380,348 | 4/1968 | Kroffke | 91/318 |
| 3,430,652 | 3/1969 | Struck | 137/624.14 |
| 3,459,363 | 8/1967 | Miller | 417/446 |
| 3,494,376 | 2/1970 | Doeringsfeld et al. | 137/624.14 |
| 3,607,094 | 9/1971 | Beer | 417/446 |
| 4,077,569 | 3/1978 | Deines | 239/101 |
| 4,114,515 | 9/1978 | Pauliukonis | 91/284 |
| 4,265,403 | 5/1981 | Bonetti | 239/66 |
| 4,838,768 | 6/1989 | Flaherty | 417/308 |
| 5,036,876 | 5/1991 | Jernberg | 251/82 |
| 5,067,520 | 11/1991 | Kremer et al. | 251/82 |
| 5,070,907 | 12/1991 | Salecker | 137/624.11 |
| 5,094,597 | 3/1992 | Takai et al. | 417/427 |

*Primary Examiner*—Richard A. Bertsch
*Assistant Examiner*—Peter Korytnyk
*Attorney, Agent, or Firm*—Wood, Phillips, VanSanten, Hoffman & Ertel

[57] ABSTRACT

A fluid pump having a casing defining a fluid inlet a fluid outlet and first and second cylinders, a first piston mounted to the casing for movement in first and second directions with the first piston causing fluid in the inlet to be drawn into the first cylinder as the first piston moves in the first direction and causing fluid in the first cylinder to be discharged from the first cylinder towards the outlet and the second cylinder as the first piston moves in the second direction, a second piston mounted to the casing for movement in third and fourth directions with the second piston being movable in a third direction without drawing significant amounts of fluid from the inlet into the second cylinder and causing fluid in the second cylinder to be discharged from the second cylinder towards the outlet as the second piston moves in the fourth direction, and structure for driving the first piston reciprocatively in the first and second directions and the second piston reciprocatively in the third and fourth directions.

22 Claims, 3 Drawing Sheets

FLUID PUMP WITH PULSING FEATURE

BACKGROUND OF THE INVENTION

1. Field of the Invention

This invention relates to fluid pumps and, more particularly, to a pump for providing a pulsed delivery of fluid to a point of use.

2. Background Art

High pressure water has long been used to clean blocked and silted drainage, sewer, and other conduits. Water is pumped through a flexible hose at high pressure and is expelled controllably at a downstream nozzle. Jets on the nozzle direct the discharging water angularly with respect to the hose in a trailing direction.

To effect a cleaning operation, the nozzle, which is normally at the leading end of the hose, is introduced to the sewer or other conduit to be cleaned. The water discharging from the jets propels the nozzle and hose forwardly through the conduit. At the same time, the pressurized water scours the walls of the conduit. If excessive or stubborn buildup is present in the conduit, a leading jet may be provided to propel liquid forwardly to break through any obstruction and define a path for the nozzle.

The above technique is employed using different nozzle and hose types, different flow rates and volumes and different pressures, as the particular job dictates. With this technique, it is possible to penetrate and effectively clean conduits up to 400 feet in length. This length is generally the maximum that is encountered for industrial, municipal, and household applications by reason of the regular access afforded through manholes.

While it may be possible to penetrate longer conduits with the above described technique, this technique may not be adequate where curves, elbows, and traps are encountered and/or when the conduit length significantly exceeds 400 feet. To enhance advancement of the nozzle, particularly through a long, circuitous conduit pathway, and break up obstructions, it is known to interrupt the nozzle flow to produce a pulsed fluid delivery through the nozzle. It is a known principle that repetitive interruption of high pressure flow through a nozzle to cause a pulsating action will result in the nozzle and hose continuing to progress through a conduit over or around obstructions more effectively than can be achieved by the steady pull obtained from a constant rearward expulsion of fluid.

A number of systems have been devised to produce pulsed discharge of a fluid. One such system is shown in U.S. Pat. No. 4,838,768, to Flaherty. Flaherty employs two pistons which alternatingly operate to discharge fluid through an outlet. Pulses from the separate pistons are timed to immediately follow one another. It is also possible to disable one of the pistons to provide a lag between successive pulses by a single one of the pistons.

Overall, the Flaherty system is relatively complicated and, by reason of requiting custom building, may be relatively expensive. There are five check valves in the system and multiple moving pistons. Failure of any element may result in system malfunction. Another problem with the Flaherty system is that it is inherently quite cumbersome by reason of there being multiple pistons and flow passages associated therewith.

The inventor herein designed a pulsating liquid jet apparatus that is the subject of U.S. Pat. No. 5,070,907. This unit has enjoyed ongoing commercial success.

The unit in U.S. Pat. No. 5,070,907, while highly effective, has a number of drawbacks common to systems of similar design. The operation of the unit may be altered when the unit is used to deliver hot water, which is commonly done when it is desired to eliminate a frozen blockage in a conduit. The hot water, which is typically at 140°–160° F., effects the function of the springs within the unit which may result in compromised and/or different performance characteristics for the unit.

Another problem with the above unit is that as the unit capacity is increased, the piston must be proportionately increased in size. Accordingly, it may in some situations be necessary to significantly increase the overall size of the unit. It is always the objective of designers of such systems to minimize their size, due to the fact that the units are commonly transported to and around job sites.

Many other systems are currently known for producing a pulsed delivery of a fluid, but these systems likewise have drawbacks which demonstrate the need for an improved fluid pump.

SUMMARY OF THE INVENTION

It is one of the principal objectives of the present invention to provide a pump for producing a pulsating or vibratory action on a hose through which fluid is propelled by the pump, and to make that pump relatively simple in form yet highly reliable and consistent in operation during pumping of both hot and cold fluids.

More particularly, in one form of the invention, a fluid pump is provided having a casing defining a fluid inlet a fluid outlet and first and second cylinders, a first piston mounted to the casing for movement in first and second directions with the first piston causing fluid in the inlet to be drawn into the first cylinder as the first piston moves in the first direction and causing fluid in the first cylinder to be discharged from the first cylinder towards the outlet and the second cylinder as the first piston moves in the second direction, a second piston mounted to the casing for movement in third and fourth directions with the second piston being movable in a third direction without drawing significant amounts of fluid from the inlet into the second cylinder and causing fluid in the second cylinder to be discharged from the second cylinder towards the outlet as the second piston moves in the fourth direction, and structure for driving the first piston reciprocatively in the first and second directions and the second piston reciprocatively in the third and fourth directions.

The second piston and cylinder have an associated valve with a seat being defined by the casing for the valve. The valve is movable between an open position and a seated position. In the open position, the valve allows fluid to be directed by the first piston from the first cylinder into the second cylinder. Structure is provided for maintaining the valve in its open position as the second piston moves both in the third and fourth directions. Interruption of otherwise continuous flow takes place as fluid discharged from the first cylinder is diverted to the second cylinder. This flow diversion is permitted by reason of the second cylinder not drawing in a full charge of fluid from the inlet as it moves in the third direction. The result is that an interruption of flow results which produces the desired pulsing/vibratory action.

The valve can be maintained in a plurality of different positions relative to the valve seat to change the pulsing action as desired.

It is another objective of the present invention to allow the pump to be used selectively as a pulsing unit or as a unit to produce a continuous, constant flow volume. By disabling the structure for maintaining the valve open, the valve will normally seat as the pump operates so that the second piston can draw in fluid from the inlet as the second piston moves in the third direction.

In one form, the structure for maintaining the valve open includes an elongate shaft to which the valve is connected. The shaft is movable relative to the casing to reposition the valve. This relative movement can be accomplished by threadably connecting the shaft and easing and rotating the shaft relative to the casing to effect the desired adjustment.

In one form, a mounting block is provided on the casing, with the shaft being in turn connected to the mounting block for movement relative thereto. The mounting block can likewise be threadably connected to the casing.

To facilitate repositioning of the shaft and associated valve, an enlarged knob can be provided on the shaft externally of the casing. The knob can be gripped and turned to rotate the shaft and thereby reposition the shaft relative to the mounting block/casing.

In one form, the shaft is elongate and is movable relative to the casing in first and second lengthwise directions. Structure can be provided for limiting movement of the shaft relative to the easing in each of the first and second lengthwise directions to consistently place the shaft in a) one position in which pulsed delivery of fluid will be effected and b) a second position wherein the pump operates to produce a continuous, substantially uninterrupted flow. The limiting structure can be, for example, split rings which can be snapped in place at strategic locations on the shaft.

One of the rings can be used to back a spring which urges the valve in one lengthwise direction relative to the shaft.

The invention further contemplates an improved fluid pump of the type having a casing defining a fluid inlet a fluid outlet and first and second cylinders, a first piston for drawing fluid from the inlet into the first cylinder and for discharging fluid in the first cylinder to the fluid outlet, a second piston for drawing fluid from the inlet into the second cylinder and for discharging fluid in the second cylinder to the fluid outlet, a first valve associated with the first piston and first cylinder and movable between an open position and a seated position, a second valve associated with the second piston and second cylinder and movable between an open position and a seated position, and structure for reciprocatively operating the first and second pistons. The improvement relates to structure for maintaining one of the first and second valves in its open position as the first and second pistons are operated.

With the inventive structure, existing, continuous flow pumps can be modified to produce a pulse/vibratory discharge simply by repositioning one of the valves. Normally, such pumps have plugs threaded to the ends of the cylinders. By simply removing the plug, the inventive structure could be retrofit to the pump in the plug opening with only minor modification. The user is afforded the option of using the pump to produce a continuous flow or a pulsed/vibratory flow.

Since the unit does not have to be custom built for pulse/vibratory flow, it can be made relatively inexpensively. The pulsed discharge can be produced without significantly altering the flow volume and flow pressure of the unit. At the same time, no parts are introduced to the existing pump which are heat sensitive. Thus the pump can be used with hot and cold water and will perform consistently with both.

The invention can be practiced with any pump that has at least two operating pistons. More than one piston/cylinder assembly can be modified according to the present invention.

DETAILED DESCRIPTION OF THE DRAWINGS

Figure 1:
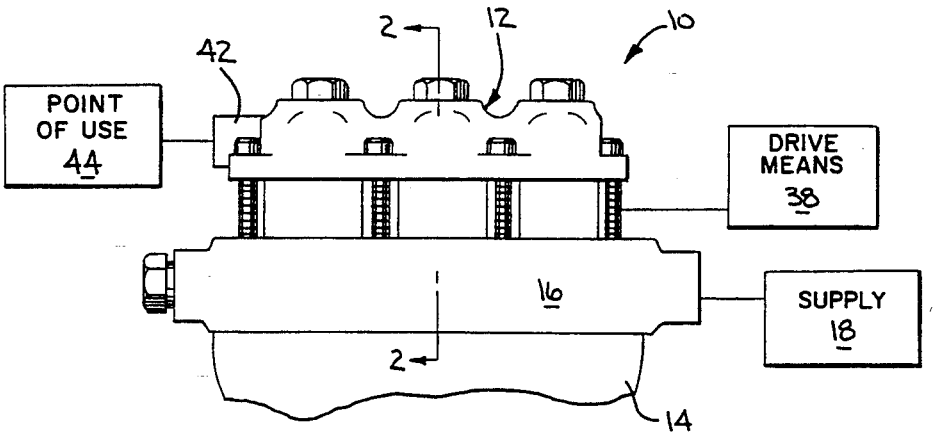
FIG. 1 (PRIOR ART)
FIG. 1 is a fragmentary, side elevation view of a head on a conventional piston-type fluid pump.
Figure 2:
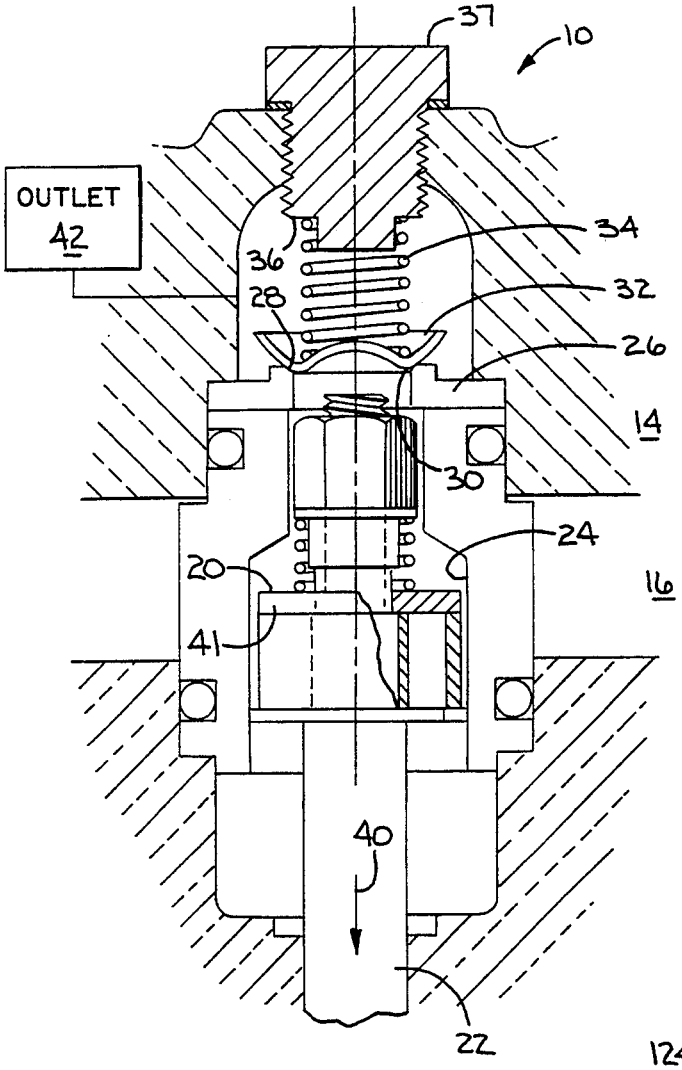
FIG. 2 (PRIOR ART)
FIG. 2 is an enlarged, cross-sectional view of one of the piston/cylinder assemblies taken along line 2—2 of FIG. 1.

In FIGS. 1 and 2, a conventional, piston-type fluid pump is shown at 10. The fluid pump 10 is of a conventional construction well known to those skilled in the art. Consequently, a detailed description of the overall pump operation is unnecessary. The particular pump shown is of the type made by Cat Pumps Corporation of Minneapolis, Minn. The description herein will be limited primarily to the pump head 12, with which the present invention is associated.

The pump 10 has a casing 14 defining an inlet manifold 16 for receiving fluid from a supply 18. A plurality of, and in this exemplary unit three, pistons 20 are mounted on rods 22 for reciprocating movement, one each within a cylinder 24.

A seat 26 is defined above the piston 20 and has an annular surface 28 to facially abut a matching surface 30 on a movable valve 32. The valve 32 is normally biased into its seated position, as shown in FIG. 2, by a coil spring 34 which acts between an annular shoulder 36 on a fixed plug 37 that is threaded into the pump head 12, and the valve 32.

As the piston 20 is operated by a drive means 38 and moves downwardly in the direction of the arrow 40, a suction force is developed in the cylinder chamber 24 which draws the fluid into the cylinder 24 through the piston 20 and around a spring-loaded disk 41, which unseats as the piston 20 moves downwardly. Subsequent opposite movement of the piston 20 drives the fluid against the valve 32, which unseats the valve 32 and places it in an open position against the bias of the spring 34, to allow the fluid to be communicated from the cylinder 24 to an outlet 42 and a point of use 44.

The pistons 20 are synchronized so that the fluid is expelled from the outlet 42 at a substantially continuous pressure and volume.

Figure 3:
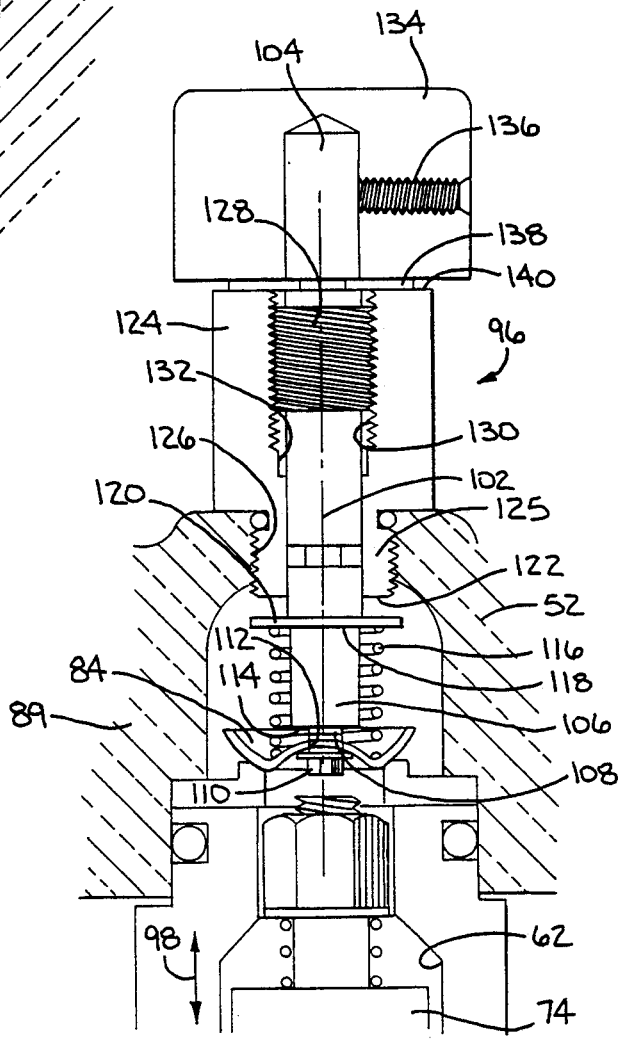
FIG. 3 is a cross-sectional view of a piston/cylinder assembly as in FIG. 2 with the present invention incorporated therein and with the structure set for continuous flow delivery.
Figure 4:
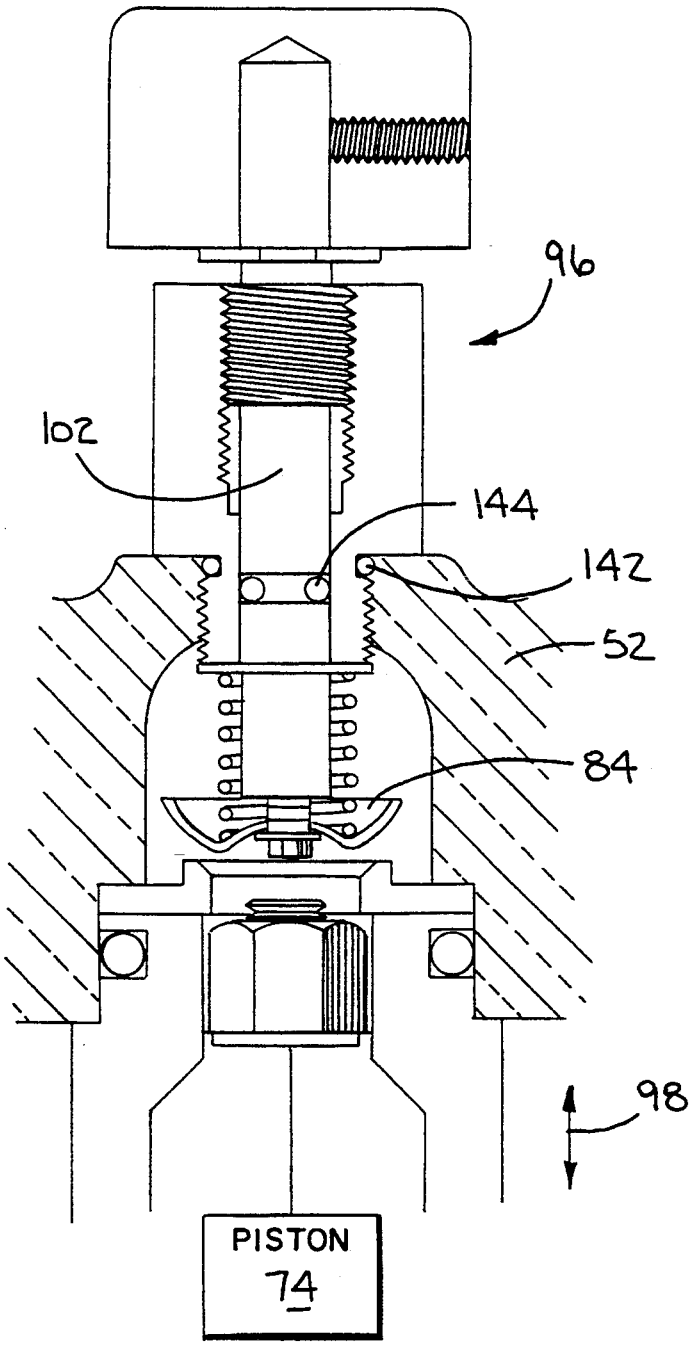
FIG. 4 is a view as in FIG. 3 with the structure set for pulse/vibratory delivery of a fluid.

The present invention contemplates either a modification to an existing piston-type pump or custom building of a fluid pump to produce a pulsed/vibratory discharge of fluid from the pump. Details of the invention are shown in FIGS. 3–5.

Figure 5:
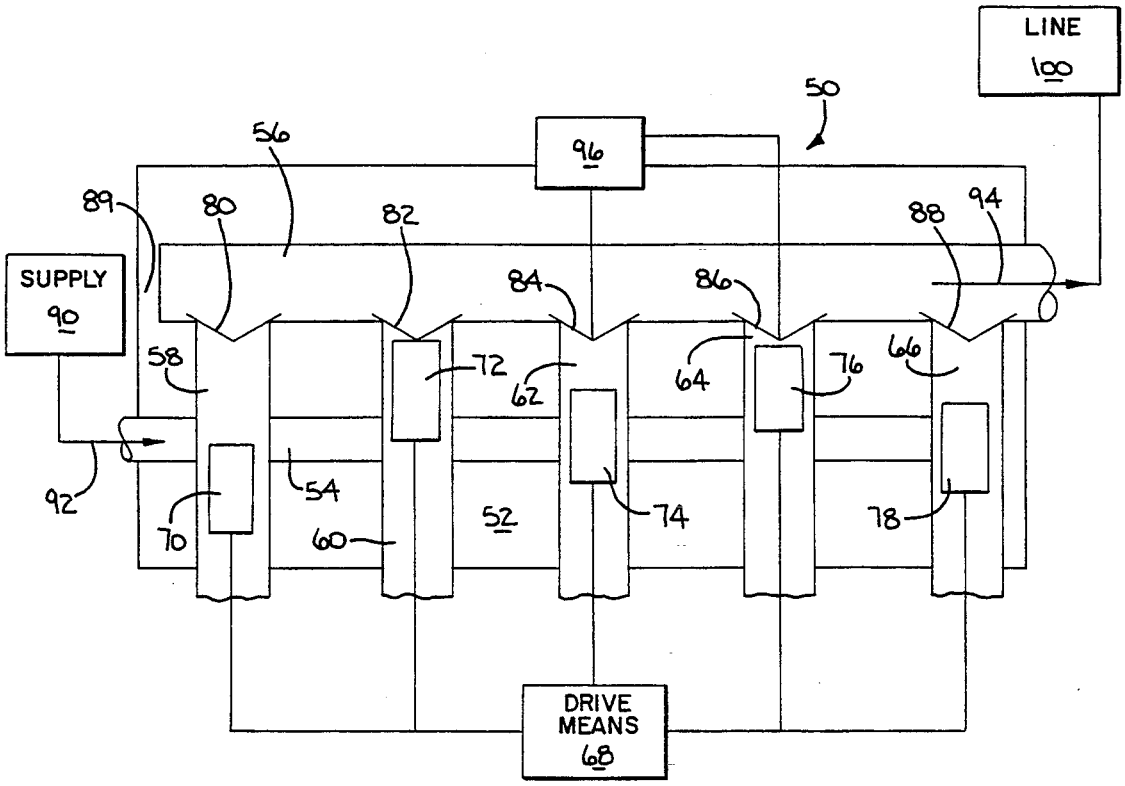
FIG. 5 is a schematic representation of a five piston pump head with the present invention incorporated therein.

In FIG. 5, a fluid-type piston pump, according to the present invention, is shown schematically at 50. The pump has a casing 52 defining an inlet manifold 54, an outlet manifold 56 and five cylinders 58, 60, 62, 64, 66, each in communication with the inlet manifold 54 and outlet manifold 56. A drive means 68 reciprocatively operates pistons 70, 72, 74, 76, 78 within cylinders 58, 60, 62, 64, 66, consecutively. There is a valve 80, 82, 84, 86, 88 associated, one each, with the cylinders 58, 60, 62, 64, 66. The pistons 70, 72, 74, 76, 78 are removable as a unit with a head section 89 that is separable from the remainder of the casing 52.

The pistons 70, 72, 74, 76, 78 are synchronized to normally draw fluid from a supply 90 in the direction of the arrow 92 into the manifold 54 to discharge the fluid into the outlet manifold 56 for delivery in the direction of the arrow 94 to a point of use.

According to the invention, one or more of the valves 80, 82, 84, 86, 88 is modified. One exemplary valve 84 is shown modified, according to the present invention, in FIGS. 3 and 4. More specifically, according to the invention, a means is provided at 96 for maintaining the valve 84 in its open position as the piston 74 reciprocates in the line of the double-headed arrow 98.

More specifically, with the means 96 disabled, the valve 84 operates in normal fashion. That is, it remains in the seated position of FIG. 3 as the piston 74 moves downwardly while fluid is drawn from inlet manifold 54, through piston 20, into the cylinder 62 and moves to an open position, as shown in FIG. 4, as the piston 74 moves upwardly.

With the means 96 in its operative state, as shown in FIG. 4, the valve 84 is drawn upwardly and maintained in its open state. As a result, as the other pistons 70, 72, 76, 78 are driven upwardly, they discharge fluid into the cylinder 62 around the open valve 84. As a result, there is a momentary pressure loss in the outlet manifold 56 and a prevention of fluid entering cylinder 62 from the inlet manifold 54. As the piston 74 moves upwardly, it discharges the accumulated fluid directed thereinto by the other pistons 70, 72, 76, 78 to increase the pressure of the fluid in the manifold 56. These pressure changes cause a pulsing action in a flexible line 100 communicating with the discharge manifold 56.

A similar means 96 is shown on the valve 86. It is preferred, regardless of the number of piston/cylinder assemblies that are provided, that no more than half be equipped with the means 96 placed in an operative state at any one time. The means 96 can be associated with any one or more of the valves 80, 82, 84, 86, 88. The showing of the means 96 on the two valves 84, 86 is made only for purposes of illustration.

The means 96 includes an elongate shaft 102 with a top end 104 and a bottom end 106. The bottom end 106 has a reduced diameter extension 108 with an enlarged head 110 at the free end thereof. The valve 84 has a bore 112 to receive the extension 108. The valve 84 is confined in movement between a shoulder 114 on the shaft 102 and the head 110.

The valve 84 is normally biased downwardly towards the head 110 by a coil spring 116 which surrounds the shaft 102 and acts between a shoulder 118 on a ring 120 attached to the shaft 102. The ring 120, which may be in the form of a split or "E" ring, can be snapped into place and serves the dual purpose of providing a backing surface for the spring 116 and abutting to the bottom wall 122 of a mounting block 124 to thereby limit upward movement of the shaft 102 and valve 84 relative to the casing 52.

The mounting block 124 has a reduced diameter portion 125 that fits in place of the plug 37 which is removed from a pre-drilled threaded bore 126 at the top of the piston head 89 on the casing 52. The shaft 102 in turn has external threads 128 which engage female threads 130 in a through bore 132 in the mounting block 124.

An enlarged knob 134 is placed over the upper end 104 of the shaft 102 and maintained in place thereon by a set screw 136. The position of the valve 84 is established by rotating the knob 134, which in turn rotates the shaft 102 to effect lengthwise movement thereof.

With the means 96 in its operative state, a ring 138, such as the ring 120, attached to the shaft 102, abuts to the top wall 140 of the mounting block 124 to arrest downward movement of the shaft 102 and thereby consistently places the valve 94 in a normal state, i.e. with the means 96 disabled so that the pump operates in conventional fashion.

By rotating the knob 134 in the opposite direction, the valve 84 is drawn upwardly to the position shown in FIG. 4, which represents the operative state for the means 96. The ring 120 abuts to the mounting block 124 to consistently define the operative state for the means 96.

To prevent fluid leakage, an O-ring 142 is interposed between the mounting block 124 and casing 52. A separate O-ring 144 surrounds the shaft 102 and seals between the shaft 102 and mounting block 124.

By removing the plug 37 from a conventional pump, the subassembly consisting of the shaft 102, mounting block 124 and knob 134 can be attached to the casing 52 by simply threading the reduced diameter portion 125 of the mounting block 124 into the casing 52. The ring 120 can be snapped onto the shaft 102 with the means 96 in place. Access to the ring location can be gained with the head 89 separated from the remainder of the casing 52. Similarly, the valve 94 is operatively positioned on the shaft extension 108. The enlarged head 110 can be defined by a bolt, or the like, which is threaded into the extension 108 to captively hold the valve 94 in place.

It can be seen that an existing pump can be simply retrofit with the inventive structure to change a conventional pump into one that will produce a pulsing/vibratory action. The means 96 which is used to effect this conversion is relatively simple and inexpensive to construct. At the same time, since the basic mechanism of the pump is only slightly altered, the reliability of the pump is not compromised. In essence, the invention involves converting a conventional pump so as to end up with one less moving part, rather than complicating the structure thereof. There are no seals or heat sensitive springs that would result in any change in function with hot and cold fluid. The pressure loss due to the means 96 is relatively small and can be compensated for through a conventional pressure regulator. Still further, unlike some prior art structure, the pulsing is not caused by flow blockage, which stresses parts, intermittently places a significant load on the electrical system, and detrimentally affects the overall pump operation.

The foregoing disclosure of specific embodiments is intended to be illustrative of the broad concepts comprehended by the invention.

I claim:

1. A fluid pump comprising:

a casing defining a fluid inlet manifold, a fluid outlet and first and second cylinders;

a first piston;

first means for mounting the first piston to the casing for movement in first and second directions within the first cylinder;

first means cooperating between the casing and first piston for a) causing a first predetermined amount of fluid in the inlet manifold to be drawn into the first cylinder as the first piston moves in the first direction and b) causing a second predetermined amount of fluid in the first cylinder to be discharged from the first cylinder toward the outlet as the first piston moves in the second direction;

a second piston;

second means for mounting the second piston to the casing for movement in third and fourth directions;

means for driving a) the first piston reciprocatively in the first and second directions and b) the second piston reciprocatively in the third and fourth directions; and second means cooperating between the casing and second piston for controlling movement of fluid into and out of the second cylinder as the second piston is operated, said second cooperating means having first and second states, said second cooperating means in said first state a) allowing a third predetermined amount of fluid to be drawn from the inlet manifold into the second cylinder as the second piston moves in the third direction and b) causing a fourth predetermined amount of fluid to be discharged toward the outlet as the second piston moves in the fourth direction with the third predetermined amount of fluid in the second cylinder, wherein movement of the first and second pistons is synchronized so that with the second cooperating means in the first state fluid is discharged in a continuous stream at the fluid outlet, said second cooperating means in said second state allowing no more than a fifth predetermined amount of fluid to be drawn from the inlet manifold into the second cylinder as the second piston moves in the third direction, said fifth predetermined amount of fluid being less than the fourth predetermined amount of fluid whereby with the second cooperating means in the second state and the fifth predetermined amount of fluid in the second cylinder, movement of the second piston in the fourth direction causes a sixth predetermined amount of fluid to move towards the outlet after the fourth predetermined amount, said sixth predetermined amount being sufficiently less than the fourth predetermined amount that there is a pressure reduction at the outlet that causes a pulsed delivery of fluid at the outlet.

2. The fluid pump according to claim 1 wherein the second cooperating means includes a valve and a seat defined by the casing for the valve, said valve being movable between an open position with the second cooperating means in its first state and a seated position with the second cooperating means in its second state, said valve in said open position allowing fluid to be directed by the first piston from the first cylinder into the second cylinder, said second cooperating means further including a third means on the casing for maintaining the valve in one of its open and closed positions as the second piston moves both in the third and fourth directions.

3. The fluid pump according to claim 2 wherein the third means comprises means for selectively maintaining the valve fixedly in a plurality of different positions relative to the valve seat.

4. The fluid pump according to claim 3 wherein the third means includes an elongate shaft to which the valve is connected and means for connecting the shaft to the casing for selective movement of the shaft relative to the casing lengthwise of the shaft.

5. The fluid pump according to claim 4 wherein the means for connecting the shaft to the casing comprises means for threadably connecting the shaft to the casing.

6. The fluid pump according to claim 5 wherein the third means includes a mounting block on the casing and the means for threadably connecting the shaft to the casing threadably connects the shaft to the mounting block.

7. The fluid pump according to claim 6 wherein the mounting block is threadably connected to the casing.

8. The fluid pump according to claim 4 wherein the shaft is movable selectively in first and second lengthwise directions and means are provided on the casing for limiting movement of the shaft relative to the casing in at least one of the first and second lengthwise directions.

9. The fluid pump according to claim 4 including an enlarged knob on the shaft externally of the casing to facilitate gripping of the knob by hand and effecting rotation of the knob and shaft.

10. The fluid pump according to claim 2 wherein the third means has an operative state and a disabled state, and with the third means in the disabled state the valve is movable reciprocatively between the open position and the seated position as the driving means is operated and with the third means in its operative state the third means maintains the valve in its open position.

11. An improved fluid pump of the type having a casing defining a fluid inlet manifold, a fluid outlet, first and second cylinders, a first piston for drawing fluid from the inlet manifold into the first cylinder and for discharging fluid in the first cylinder towards the fluid outlet manifold, a second piston for drawing fluid from the inlet into the second cylinder and for discharging fluid in the second cylinder towards the fluid outlet, a first valve associated with the first piston and a first cylinder and movable between an open position and a seated position, a second valve associated with the second piston and second cylinder and movable between an open position and a seated position, and first means for reciprocatively operating the first and second pistons to cause fluid to be drawn from the inlet manifold past the first and second valves into the first and second cylinders and discharged by the first and second pistons from the first and second cylinders towards the outlet, the improvement comprising:

means for fixing the position of one of the first and second valves as the first means is continuously operated.

12. The improved fluid pump according to claim 11 wherein the mounting means comprises means for maintaining the one of the first and second valves in a plurality of positions between the open and seated positions for the one of the first and second valves.

13. The improved fluid pump according to claim 11 wherein the mounting means includes a shaft to which the one of the first and second valves is connected and means for connecting the shaft to the casing for movement relative to the casing.

14. The improved fluid pump according to claim 13 wherein the means for connecting the shaft to the casing comprises means for threadably connecting the shaft to the casing.

15. The improved fluid pump according to claim 13 wherein the shaft is movable in opposite directions relative to the casing and means are provided on the shaft for limiting movement of the shaft relative to the casing in each of the opposite directions.

16. The improved fluid pump according to claim 15 wherein the means for limiting movement of the shaft comprises a plurality of rings attached to the shaft.

17. The improved fluid pump according to claim 14 including an enlarged knob on the shaft externally of the casing to facilitate gripping of the knob by hand and effecting rotation of the knob and shaft.

18. The improved fluid pump according to claim 16 wherein one of the rings defines a shoulder and biasing means are provided between the shoulder and the one of the first and second valves for urging the one of the first and second valves in one of said opposite directions.

19. The improved fluid pump according to claim 11 wherein the casing has a pre-drilled bore communicating between one of the first and second cylinders and externally of the casing and a solid plug within the casing and the means for maintaining the one of the first and second valves is mounted to the casing to extend through the pre-drilled bore.

20. The improved fluid pump according to claim 19 wherein the maintaining means includes a mounting block on the casing and a shaft with the one of the first and second valves thereon threadably connected to the mounting block.

21. A fluid pump comprising:

a casing defining a fluid inlet manifold, a fluid outlet and first and second cylinders;

a first piston;

first means for mounting the first piston to the casing for movement in first and second directions within the first cylinder;

first means cooperating between the casing and first piston for a) causing fluid in the inlet manifold to be drawn into the first cylinder as the first piston moves in the first direction and b) causing fluid in the first cylinder to be discharged from the first cylinder towards the outlet as the first piston moves in the second direction;

a second piston;

second means for mounting the second piston to the casing for movement in third and fourth directions;

second means cooperating between the casing and the second piston for a) allowing the second piston to move in the third direction without drawing any fluid from the inlet manifold into the second cylinder while allowing entry of fluid discharged from said first cylinder into said second cylinder and b) causing fluid in the second cylinder to be discharged from the second cylinder towards the outlet as the second piston moves in the fourth direction; and means for driving a) the first piston reciprocatively in the first and second directions and b) the second piston reciprocatively in the third and fourth directions.

22. A fluid pump comprising:

a casing defining a fluid inlet manifold, a fluid outlet and first and second cylinders;

a first piston;

first means for mounting the first piston to the casing for movement in first and second directions within the first cylinder;

first means cooperating between the casing and first piston for a) causing fluid in the inlet manifold to be drawn into the first cylinder as the first piston moves in the first direction and b) causing fluid in the first cylinder to be discharged from the first cylinder towards the second cylinder as the first piston moves in the second direction;

a second piston;

second means for mounting the second piston to the casing for movement in third and fourth directions;

second means cooperating between the casing and the second piston for a) allowing the second piston to move in the third direction and entry of fluid discharged from the first cylinder into the second cylinder and b) causing fluid in the second cylinder to be discharged from the second cylinder towards the outlet as the second piston moves in the fourth direction; and means for driving a) the first piston reciprocatively in the first and second directions and b) the second piston reciprocatively in the third and fourth directions, whereby there is a momentary pressure drop at the outlet as fluid discharged from the first cylinder enters the second cylinder to thereby cause a pulsed delivery of fluid at the outlet.

* * * * *